United States Patent [19]

Sutton

[11] 4,408,435

[45] Oct. 11, 1983

[54] WRAPPING MACHINES

[75] Inventor: Leonard Sutton, Gainsborough, England

[73] Assignee: Baker Perkins Holdings Limited, Peterborough, England

[21] Appl. No.: 220,439

[22] Filed: Dec. 29, 1980

[30] Foreign Application Priority Data

Feb. 14, 1980 [GB] United Kingdom ..... 8004912

[51] Int. Cl.[3] ..... B65B 11/32

[52] U.S. Cl. ..... 53/225; 53/234; 198/459

[58] Field of Search ..... 53/225, 234, 227; 198/459

[56] References Cited

U.S. PATENT DOCUMENTS

| | | | |
|---|---|---|---|
| 1,330,596 | 2/1920 | Loweree | 198/459 |
| 1,545,513 | 7/1925 | Peters | 53/234 X |
| 1,689,247 | 10/1928 | Lange | 198/459 |
| 2,007,981 | 7/1935 | Nordquist | 198/459 X |
| 2,621,841 | 12/1952 | Simpson | 198/459 X |
| 2,643,501 | 6/1953 | Russell | 53/234 |
| 3,818,675 | 6/1974 | Griner | 53/234 X |
| 3,899,865 | 8/1975 | Revaz | 53/234 |
| 3,987,605 | 10/1976 | Johnson | 53/234 |

FOREIGN PATENT DOCUMENTS

| | | | |
|---|---|---|---|
| 2103627 | 8/1971 | Fed. Rep. of Germany | 198/461 |
| 134621 | 3/1979 | German Democratic Rep. | 53/234 |
| 1032417 | 6/1966 | United Kingdom | 53/234 |
| 2058705 | 4/1981 | United Kingdom | 53/229 |

*Primary Examiner*—John Sipos

*Attorney, Agent, or Firm*—Watson, Cole, Grindle & Watson

[57] ABSTRACT

A sweet wrapping machine includes a continuously rotating feed disc (12) having regularly pitched sweet-receiving pockets (13), a continuously rotating wrapping wheel (44) having pockets (43) spaced at a greater pitch than the pockets in the feed disc, and a continuously rotating transfer wheel (16) including pockets (15) which receive the sweets from the pockets in the feed disc and transfer them to the pockets of the wrapping wheel. The pockets (15) are on the ends of arms (25) which are shifted during rotation of the transfer wheel from a spacing conforming to the pockets in the feed disc to a spacing conforming to the pockets of the wrapping wheel.

6 Claims, 2 Drawing Figures

WRAPPING MACHINES

It has long been the practice in sweet wrapping machines to supply the sweets individually to successive pockets of a wrapping machine from circumferentially spaced pockets in an intermittently rotating horizontal feed disc, to which the sweets are supplied by a vibrating feeder.

To match the increased rate of output required from modern machines, it is known to use a constantly rotating feed disc and an elevator mechanism which includes a series of fingers, which lift the sweets in succession from the pockets in the feed disc and have a component of movement in the direction of travel of the feed discs. Such a mechanism is described in British Pat. No. 1032417.

The present invention provides a machine in which the sweets are delivered in succession from the pockets of a constantly rotating feed disc to the pockets of a continuously rotating wrapping wheel.

In such a machine it is necessary for the pockets of the wrapping wheel to be spaced apart at a pitch sufficient to accommodate the various wrapper folding and twisting mechanisms. It is also desirable for the feed disc to be provided with a greater number of pockets than the wrapping wheel, and also for the feed disc to be rotated at a much slower rate than the wrapping wheel to provide the necessary time to ensure that the sweets are distributed from a disorderly mass on the disc into the individual pockets of the disc during rotation thereof. With such an arrangement the pitch of the pockets of the feed disc is far less than the pitch of the pockets of the wrapping wheel.

A similar problem of mismatch in pitch arises in machines in which the sweets are fed to the wrapping wheel by a chain conveyor, comprising pockets to receive the sweets or pushers for advancing the sweets in procession along a deadplate. In this case it is also desirable for the infeed chain to have a short pitch so that it is not excessively lengthy.

It is an object of the invention to provide for transfer in a simple and effective manner of sweets in succession from an infeed conveyor which supplies the sweets at a close pitch to successive pockets of a wrapping wheel disposed at a greater pitch.

The invention accordingly provides a sweet wrapping machine, which comprises a continuously moving infeed conveyor for supplying a continuous procession of regularly pitched sweets, a continuously operating elevator mechanism for lifting the sweets individually and in succession from the infeed conveyor, a continuously rotating wrapping wheel having pairs of sweet receiving jaws which are equally spaced at a pitch greater than that of the sweets on the infeed conveyor, a continuously rotating transfer wheel, disposed between the infeed conveyor and the wrapping wheel and including a number of radially extending arms, each of which carries a pair of sweet receiving jaws, the arms moving in a path between a first transfer station at which the jaws receive successive sweets from the elevator mechanism and a second transfer station at which the sweets are transferred in succession to the jaws of the wrapping wheel, each sweet carrying a wrapper with it during the transfer, and means for shifting the arms during rotation of the transfer wheel so that they approach the first transfer station pitched circumferentially at the same spacing as the sweets on the infeed conveyor and approach the second transfer station at the same circumferential spacing as the pairs of jaws on the wrapping wheel.

A preferred embodiment of wrapping machine according to the invention is illustrated in the accompanying drawings, in which.

Figure 1:
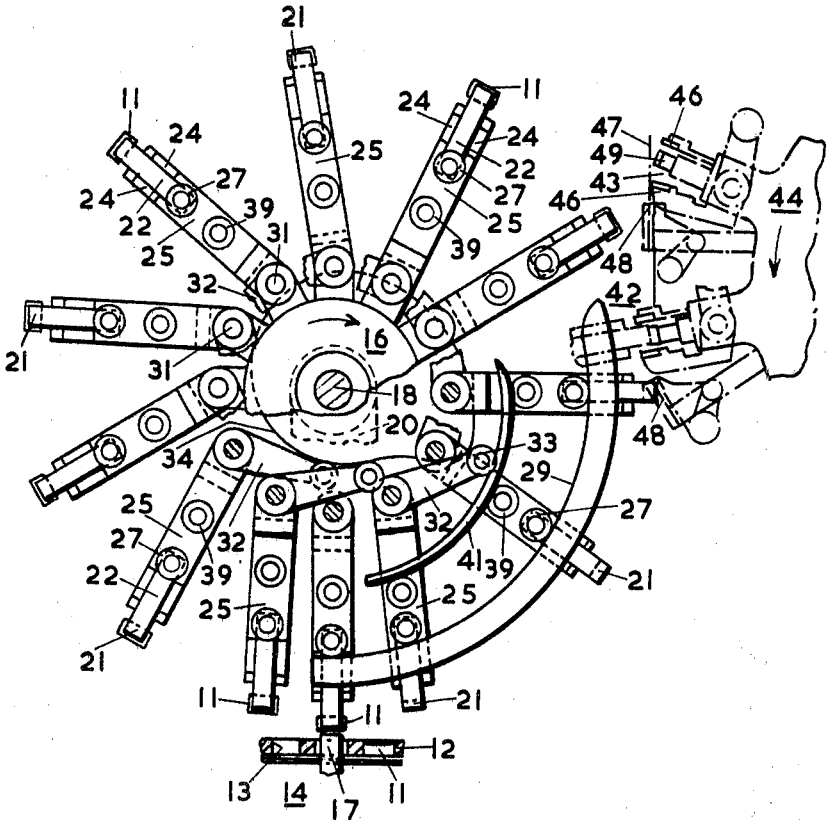
FIG. 1 is an elevation with certain parts omitted for clarity.

As shown in the drawings sweets 11 are supplied in well known manner to a continuously rotating feed disc 12 on which they are distributed by centrifugal force into pockets 13, which are formed at equal circumferential spacing in the outer portion of the disc 12. The sweets 11 are carried by rotation of the disc 12 in succession to a first transfer station 14 at which they are lifted successively from the pockets 13 towards one of a series of pockets 15 formed on a transfer wheel 16, which rotates continuously in a clockwise direction as seen in FIG. 1, by a continuously operable elevator mechanism which includes a plurality of elevators 17 (one only shown) which move in succession in a direction substantially normal to the direction of movement of the feed disc 12 into engagement with the sweets 11 in the pockets 13 of the disc 12, the elevators 17 having, as they pass through the pockets 13, a component of movement in the direction of travel of the pockets 13. Such an arrangement of elevators 17 is described in the above-mentioned British Pat. No. 1032417.

Figure 2:
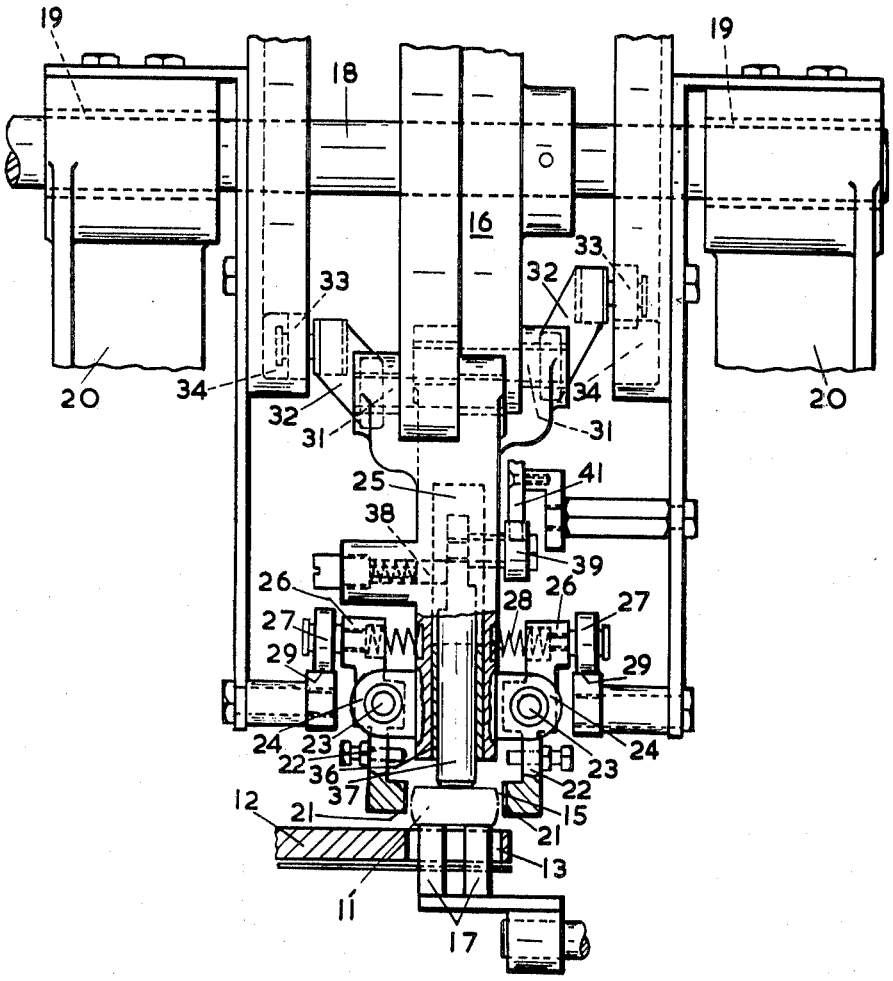
FIG. 2 is an end view of part of the apparatus shown in FIG. 1.

The transfer wheel 16 is secured to a shaft 18 rotatably mounted in bearings 19 in the framework 20 of the machine. Each pocket 15 of the transfer wheel 16 is constituted by a pair of jaws 21 (FIG. 2), the jaws 21 being formed on the outer ends of levers 22 pivoted at 23 to opposed lugs 24 extending from an arm 25. The inner end of each lever 22 is formed with a block 26 on which is rotatably mounted a roller 27 urged by a spring 28 into contact with a track 29 secured to the framework 20 and extending over a portion of the path of travel of the transfer wheel 16. Each arm 25 is pivotally mounted on a spindle 31 secured in the transfer wheel 16 and is provided with an extension 32, on which is rotatably mounted a roller 33 arranged to run in a cam track 34 secured to the framework 20. The rollers 33 on alternate arms 25 engage in cam tracks 34 at opposite sides of the transfer wheel. Each arm 25 is also provided with a bore 36 in which is mounted a trapper plunger 37, held by friction in the bore by a spring-loaded plunger 38 and provided with a roller 39 which cooperates with a track 41, positioned over a portion of the path of travel of the transfer wheel 16 just in advance of the first transfer station 14 and secured to the frame work 20. As each plunger 37 approaches the first transfer station 14 it is moved by the track 41 to a projected position in its bore 36, if it does not already occupy that position, and is then released by the track 41. The plunger 37 is therefore able to nip a sweet 11 raised by an elevator 17 to prevent uncontrolled bouncing of the sweet and ensure its correct positioning in the jaws 21 while nevertheless being free to shift upwardly in its bore if an oversize sweet should be nipped. If it should so shift, it will be returned by the track 41 to the projected position on its next approach to the first transfer station 14.

The sweets 11 are carried in succession by the pockets 15 of the transfer wheel to a second transfer station 42 where they are transferred from the pockets 15 to the pockets 43 of a continuously rotating wrapping wheel 44, indicated by chain-dot lines in FIG. 1, which also rotates in a clockwise direction. The pockets 43 of the wrapping wheel 44 are arranged at a substantially greater pitch than the pockets 13 on the feed disc and are constituted by pairs of jaws 46 arranged to be opened and closed by cam means in timed relationship with the operation of the jaws 21 of the transfer wheel 16.

The circular paths of movement of the jaws 21 and of the jaws 46 intersect at the second transfer station 42 and the jaws 21 and 46 execute opening and closing movement in mutually perpendicular directions so as to effect transfer of a sweet by closing of the jaws 46 simultaneously with opening of the jaws 21.

As each pocket 43 of the wrapping wheel 44 approaches the transfer station 42, a wrapper 47 is fed to the nip of a pair of cam-operated grippers 48 mounted on the wrapping wheel 44 and positioned adjacent the pocket 43, the wrapper 47 lying across the open end of the pocket 43 and, as each sweet 11 is transferred to the pocket 43, the wrapper 47 is released by the grippers 48 and is folded about the leading and upper and lower faces of the sweet 11 in the form of a 'U' in well known manner.

The operation of the machine will now be described with particular reference to FIG. 1. As mentioned above each sweet 11 is lifted at the first transfer station 14 by an elevator 17 towards the pocket 15 for the time being passing through that station. As they approach this station, the jaws 21 are held in the open position by the track 29 in readiness to receive the sweet 11 which has been trapped on the elevator 17 by the trapper plunger 37. During continued rotation of the transfer wheel 16 the cam track 34 controls the roller 33 to move the arm 25 and hence the jaws 21 so that at the time that the roller 27 is about to move clear of the track 29 the jaws 21 are in line with the sweet 11 on the elevator 17. As the roller 27 moves off the track the jaws 21, under the action of the springs 28, seize the sweet 11 and at the same time the elevator 17 commences its downward movement.

With the sweet thus gripped in the jaws 21, continued rotation of the transfer wheel 16 moves the sweet away from the first transfer station 14 and carries it towards the second transfer station 42. During this movement the cam tracks 34 cause the arms 25 to pivot to increase the spacing between successive pockets 15 so that, by the time the pockets 15 approach the second transfer station 42, they are arranged at the same pitch as the pockets 43 of the wrapping wheel 44. As each pocket 15 with its sweet 11 approaches the second transfer station 42 the roller 27 once again engages the track 29 which causes the jaws 21 to open at the same instant that the jaws 46 on the wrapping wheel 44 are operated by their cam means to seize the sweet 11. As transfer of the sweet to the jaws 46 takes place the wrapper grippers 48 are opened by their cam means to allow the wrapper 47 to be folded around the leading and upper and lower faces of the sweet 11 as mentioned above, the wrapper 47 being trapped on to the leading face of the sweet 11 by a wrapper nipping member 49 slidably mounted in the wrapping wheel 44. As rotation of the wrapping wheel 44 continues the trailing portions of the wrapper 47 are folded on to the trailing face of the sweet 11 in the conventional manner and the portions of the wrapper 47 extending from the end faces of the sweet 11 are twisted, to complete the wrapping operations, by pairs of twist grippers (not shown) provided for each pocket of the wrapping wheel. The wrapped sweet is discharged from the wrapping wheel at a further station.

As each arm 25 continues its movement away from the second transfer station 42 and moves towards the first transfer station 14 to receive a sweet, the jaws 21 are maintained in their open position by the track 29 and the roller 39 engages the track 41 which, should this be necessary, causes the trapper plunger 37 to slide in the bore 36 to a position in readiness to engage the upper surfaces of the sweet 11 as it is lifted by the elevator 17 towards the pocket 15. Also during this rotational movement the cam tracks 34 cause the rollers 33 to pivot the arms 25 in turn to decrease the spacing between the pockets 15 so that, by the time the pockets 15 approach the first transfer station 14, they are at the same pitch as the pockets 13 of the feed disc 12.

I claim:

1. A sweet wrapping machine, which comprises a horizontally continuously moving infeed conveyor for supplying a continuous procession of regularly pitched sweets, a vertically moving continuously operating elevator mechanism for lifting the sweets individually and in succession from the infeed conveyor, a continuously rotating wrapping wheel having pairs of sweet receiving jaws which are equally spaced at a pitch greater than that of the sweets on the infeed conveyor, a continuously rotating transfer wheel disposed above the infeed conveyor between the infeed conveyor and the wrapping wheel and including a number of radially extending arms, each of which carries a pair of sweet receiving jaws and a trapper plunger which cooperates with the elevator mechanism to trap each sweet lifted thereby into said pair of sweet-receiving jaws, the arms moving in a path between a first transfer station at which the jaws receive successive sweets from the elevator mechanism and a second transfer station at which the sweets are transferred in succession to the jaws of the wrapping wheel, means for periodically opening and closing the pairs of jaws on the transfer wheel, each of said pair of jaws opening to receive at the first transfer station a sweet lifted into said jaws by the elevator mechanism in cooperation with a transfer plunger, then closing to embrace the sweet and opening again on arrival of said pair of jaws at the second transfer station, means for imparting opening and closing movement to the jaws on the wrapping wheel in a direction perpendicular to the opening and closing movement of the jaws on the transfer wheel, each pair of jaws on the wrapping wheel closing at the second transfer station to seize a sweet from a pair of jaws on the transfer wheel at the moment of opening of said jaws on the transfer wheel, gripper means arranged to advance a wrapper into position to be partially folded around each sweet as it is transferred to a pair of jaws on the wrapping wheel, means for releasing the wrapper from said gripper means at the moment of transfer of said sweet, and means for shifting the arms during rotation of the transfer wheel so that they approach the first transfer station pitched circumferentially at the same spacing as the sweets on the infeed conveyor and approach the second transfer station at the same circumferential spacing as the pairs of jaws on the wrapping wheel.

2. A wrapping machine according to claim 1, in which the infeed conveyor is a rotary feed disc having sweet-receiving pockets disposed at equal circumferential spacing.

3. A wrapping machine according to claim 1 or claim 2, in which the arms of the transfer wheel are pivoted to the transfer wheel and carry followers which engage a cam track which controls the spacing of the arms.

4. A wrapping machine according to claim 3, in which each trapper plunger is held frictionally in its arm and coacts on its approach to the first transfer station with a fixed track which locates it in position to nip a sweet lifted by the elevator mechanism.

5. A wrapping machine according to claim 1, in which each pair of jaws on the transfer wheel is spring loaded to the closed position and which includes fixed cam tracks which coact with the jaws to open them when they reach the first and second transfer stations.

6. A wrapping machine according to claim 5, in which the wrapping wheel includes cam means operative to close the jaws of said wrapping wheel at the second transfer station simultaneously with the opening of the jaws on the transfer wheel.

* * * * *